US005515545A

United States Patent [19]

Becton

[11] Patent Number: 5,515,545

[45] Date of Patent: May 14, 1996

[54] PILLOW CASE TEE-SHIRT

[75] Inventor: Milford G. Becton, 1900 Laurel Hwy., Box 7, Seaford, Del. 19973

[73] Assignee: Milford G. Becton, Seaford, Del.

[21] Appl. No.: 373,095

[22] Filed: Jan. 17, 1995

[51] Int. Cl.[6] ..... A47G 9/00

[52] U.S. Cl. ..... 2/113; 5/490; D6/599

[58] Field of Search ..... 5/490; D6/596, D6/597, 598, 599, 601; 2/113

[56] References Cited

U.S. PATENT DOCUMENTS

| | | | |
|---|---|---|---|
| D. 256,870 | 9/1980 | Britzman | 5/490 X |
| D. 258,406 | 3/1981 | Elbaum et al. | 5/490 X |
| D. 303,897 | 10/1989 | Phillips | D6/601 |
| D. 348,583 | 7/1994 | Rubin | D6/597 |
| D. 351,525 | 10/1994 | Alexander | D6/597 |
| 2,647,261 | 8/1953 | Rassner . | |
| 3,162,868 | 12/1964 | Cramer | 5/490 |
| 3,167,782 | 2/1965 | Wilson et al. . | |
| 3,866,909 | 2/1975 | DeSantis . | |
| 4,959,879 | 10/1990 | Marxhausen | 5/490 X |
| 4,993,078 | 2/1991 | Seitz, Jr. . | |
| 5,027,457 | 7/1991 | Sweet . | |
| 5,110,124 | 5/1992 | Micco . | |

*Primary Examiner*—C. D. Crowder
*Assistant Examiner*—Shirra L. Jenkins
*Attorney, Agent, or Firm*—Dickstein, Shapiro & Morin

[57] ABSTRACT

A pillow case tee-shirt is disclosed. The tee-shirt pillow case includes a body portion having an upper portion and a lower portion, and a pair of sleeves each extending from the upper portion of the body portion. The body portion forms a lateral opening on the lower portion for receiving a pillow case wherein the body portion includes a hole formed in the upper portion of the body portion between the pair of sleeves. Means are provided for closing the hole formed in the upper body portion.

5 Claims, 1 Drawing Sheet

PILLOW CASE TEE-SHIRT

FIELD OF THE INVENTION

The present invention relates generally to pillow cases, and more particularly, to pillow cases using a modified tee-shirt.

BACKGROUND OF THE INVENTION

A need exists for a pillow case onto which the torso of a athlete such as a football, basketball, baseball player or the like can be applied to the front and back sides thereof.

The present invention provides a pillow case tee-shirt into which a pillow is placed and onto which fanciful ornamental designs, such as caricatures of persons, such as football players are placed.

DETAILED DESCRIPTION OF THE PREFERRED EMBODIMENTS

Figure 1:
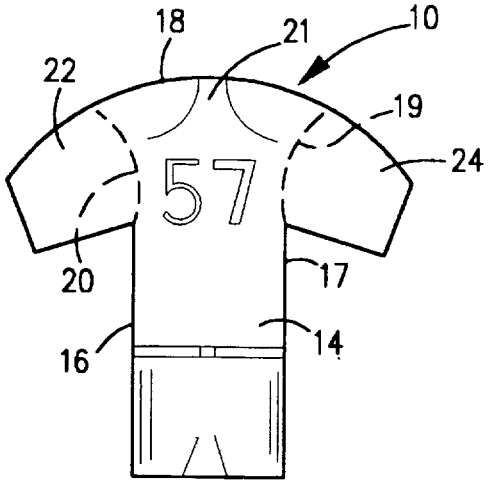
FIG. 1 is a front view showing the front side of the pillow case printed with a caricature of a football player's front torso.

Referring first to FIG. 1, there is shown therein a pillow case tee-shirt having a caricature of a front torso of a football player printed thereon which is constructed in accordance with the principles of the present invention. It should be understood that the description provided herein for FIGS. 1 and 2 is equally applicable to FIGS. 4, 5 and 6 as discussed below.

Figure 2:
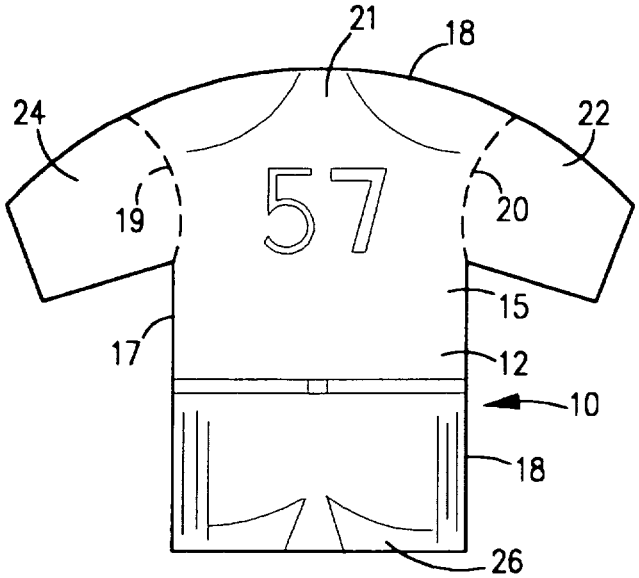
FIG. 2 is a rear view showing the back side of the pillowcase printed with the back side of the football player's rear torso.

Refer now to FIG. 1 and 2, where a pillow case tee-shirt is shown. Pillow case tee 10 includes a substantially rectangular body portion 12 made from a front portion 14 and a rear portion 15 which are pieces of substantially rectangular cloth material although many different conventional materials could be used. The two pieces of cloth material 14, 15 are stitched together along seams (not shown), along the left 16, right 17 and top 18 sides of body portion 12. On left and right sides 16, 17 are formed openings 19 and 20, respectively. Body portion 12 includes an upper portion 21. A pair of sleeves and 22 and 24, left and right respectively are conventionally attached to upper body portion 21 surrounding a respective opening 19, 20. Sleeves 22, 24 may be open on the proximal and distal ends thereof or may be stitched closed at these ends or a combination thereof.

Figure 3:
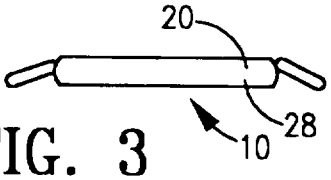
FIG. 3 is a side view showing an opening formed in one end of the pillow case.

Refer now to FIG. 3, where a side end view of pillow case tee 10 is shown. Between front portion 14 and rear portion 15 on a lower lateral end 26 thereof is an opening 28 which enables pillow case tee-shirt 10 to receive a pillow case. Alternatively, a filler material can be stuffed into pillow case tee 10, sleeves 22 and 24 closed on the distal ends thereof, and opening 28 stitched closed so as to form a single unitary pillow case.

Figure 4:
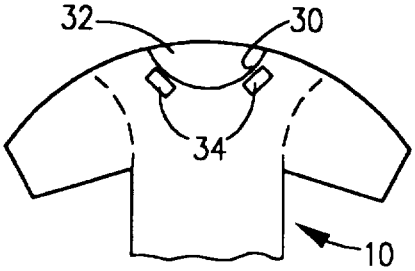
FIG. 4 is an illustration similar to FIG. 1 showing a pillowcase tee-shirt in which an opening formed in the tee-shirt is a hole closed using a piece of material and velcro fasteners.

Refer now to FIG. 4, where a second embodiment of the present invention is shown. In FIG. 4, a conventional tee-shirt is shown having a hole 30 formed in upper portion 21, into which a person's head would fit through if the tee-shirt were worn as clothing. Hole 39, is closed using a patch of material 32 which has hook and loop fasteners strips 34 attached thereto. Hook and eye fasteners, snaps and peelable adhesives can also be used for closing the hole 30 as is diagrammatically shown at 34. Attached to an inner surface of pillow case tee 10 are circumferentially spaced mating velcro fasteners. In this manner, the opening for the head can be closed and the pillow case can be fully encapsulated.

Figure 5:
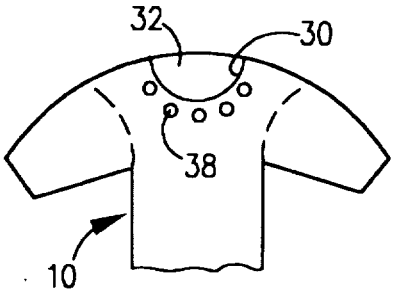
FIG. 5 is an illustration similar to FIG. 4 in which the opening formed in the tee-shirt is closed using button hooks.

Refer now to FIG. 5, where a third embodiment of the present invention shown. A patch 36 is used for closing the opening used for the head and to which buttons or button-hooks 38 are attached. Mating buttons are affixed to an inner surface of pillow case tee 10 so as to close the opening formed in the tee-shirt.

Figure 6:
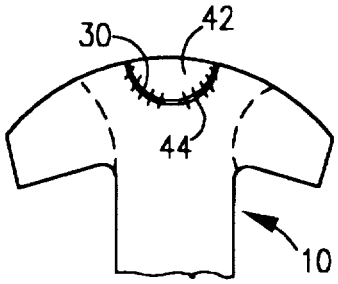
FIG. 6 is an illustration similar to FIG. 4 in which the opening formed in the tee-shirt is closed using stitches.

Refer now to FIG. 6 where a fourth embodiment of the present invention is shown. Opening 30 formed in the tee-shirt is closed using a patch 42 which is stitched by stitches 44 to the tee-shirt. It should be understood that in the embodiment shown in FIGS. 4–6, a commercially available off the shelf tee-shirt can be used so as to reduce the overall manufacturing costs associated with manufacturing an article according to the present invention.

It should be apparent from the foregoing detailed description that a pillow case tee-shirt has been described which can accommodate caricatures of the front and rear torso of a football, baseball, basketball player or the like which is simple in construction and yet desirable to be used by a child as a pillow case. The present invention may also be used in conjunction with other similar appearing items such as blankets, and the like, so as to decorate a child's room.

While this invention has been described as having preferred designs, it is understood that is capable of further modifications, uses, and/or adaptations thereof following in general the principles of the invention including such departures that have been within known or customary practice in the art to which the invention pertains.

What is claimed is:

1. A pillow case, comprising:

a) a body portion having an upper portion and a lower portion;

b) a pair of sleeves each extending from said upper portion of said body portion;

c) said body portion forming a lateral opening on said lower portion for receiving a pillow case wherein said body portion includes a hole formed in said upper portion of said body portion between said pair of sleeves; and d) means for closing said hole formed in said upper body portion.

2. The pillow case of claim 1, wherein said sleeves each have an opening formed on a lateral end thereof.

3. The pillow case of claim 1, wherein said pillow case further comprises a pillow case received in said body portion.

4. The pillow case of claim 1, wherein said closing means is selected from the group consisting of buttons, hook and eye fasteners, hook and pile fasteners, snaps and peelable adhesives.

5. The pillows case of claim 1, wherein at least one surface of said pillow case is decorated with the caricature of the upper and lower torso of a football player.

* * * * *